US008979225B2

(12) United States Patent
Eckartsberg et al.

(10) Patent No.: US 8,979,225 B2
(45) Date of Patent: Mar. 17, 2015

(54) REFRIGERATION DEVICE COMPRISING SHELVES THAT ARE SUSPENDED ON A RAIL

(75) Inventors: Peter Eckartsberg, Aalen (DE); Frank Placke, Bielefeld (DE); Matthias Stahl, Schloβ Holte-Stukenbrock (DE); Ulrich van Pels, Rheda-Wiedenbrück (DE)

(73) Assignees: BSH Bosch und Siemens Hausgeraete GmbH, Munich (DE); Miele & Cie. KG, Gütersloh (DE)

( * ) Notice: Subject to any disclaimer, the term of this patent is extended or adjusted under 35 U.S.C. 154(b) by 1162 days.

(21) Appl. No.: 12/525,566

(22) PCT Filed: Jan. 23, 2008

(86) PCT No.: PCT/EP2008/050772

§ 371 (c)(1),
(2), (4) Date: Aug. 3, 2009

(87) PCT Pub. No.: WO2008/095780

PCT Pub. Date: Aug. 14, 2008

(65) Prior Publication Data

US 2010/0001625 A1 Jan. 7, 2010

(30) Foreign Application Priority Data

Feb. 6, 2007 (DE) ..... 10 2007 005 952

(51) Int. Cl.

| | |
|---|---|
| ***A47B 96/04*** | (2006.01) |
| ***F25D 25/02*** | (2006.01) |
| ***A47B 57/42*** | (2006.01) |
| ***F25D 23/06*** | (2006.01) |

(52) U.S. Cl.

CPC ..... *F25D 25/02* (2013.01); *A47B 57/42* (2013.01); *F25D 23/067* (2013.01); *F25D 2400/18* (2013.01); *F25D 2500/02* (2013.01)

USPC ..... 312/408

(58) Field of Classification Search

USPC ..... 312/408, 404, 351, 405.1, 321.5; 108/106–108, 147.17; 248/235, 241, 248/243, 244, 250, 220.41, 220.43, 225.21; 211/103, 90.02

See application file for complete search history.

(56) References Cited

U.S. PATENT DOCUMENTS 3,194,528 A * 7/1965 Chesley ..... 248/250
3,353,684 A * 11/1967 Chesley ..... 211/187

(Continued)

FOREIGN PATENT DOCUMENTS

| | | | |
|---|---|---|---|
| CA | 2140604 | A1 | 7/1996 |
| DE | 102004021857 | A1 | 12/2005 |
| JP | 8-54179 | A | 2/1996 |

*Primary Examiner* — Daniel J Troy
*Assistant Examiner* — Hiwot Tefera
(74) *Attorney, Agent, or Firm* — James E. Howard; Andre Pallapies

(57) ABSTRACT

A refrigeration device is provided having a vertical rail that has through-openings arranged at a distance from each other and that is securely connected to a body of the refrigeration device. The refrigeration device includes a shelf support having a rear flank oriented towards the front side of the vertical rail and upper and lower hooks each having a downward oriented tip that protrudes over the rear flank and engages in one of the through-openings of the vertical rail. Only the tip of the upper hook touches the rear side of the rail and only the section of the rear flank that is arranged below the lower hook touches the front side of the rail.

18 Claims, 2 Drawing Sheets

(56) References Cited

U.S. PATENT DOCUMENTS

| | | | | | |
|---|---|---|---|---|---|
| 3,469,711 | A | * | 9/1969 | Swaneck et al. | 312/351 |
| 3,647,075 | A | * | 3/1972 | Aue | 211/153 |
| 4,022,136 | A | * | 5/1977 | Schott | 108/108 |
| 4,048,768 | A | * | 9/1977 | Good | 52/36.6 |
| 4,098,480 | A | * | 7/1978 | Neumann | 248/243 |
| 4,624,376 | A | * | 11/1986 | Bertram | 211/187 |
| 4,684,094 | A | * | 8/1987 | Everett | 248/245 |
| 5,004,201 | A | * | 4/1991 | Bessinger | 248/243 |
| 5,069,408 | A | * | 12/1991 | Bessinger | 248/250 |
| 5,116,007 | A | * | 5/1992 | Von Gunton et al. | 248/250 |
| 5,273,354 | A | * | 12/1993 | Herrmann et al. | 312/408 |
| 5,454,638 | A | * | 10/1995 | Bird et al. | 312/408 |
| 5,564,809 | A | * | 10/1996 | Kane et al. | 312/408 |
| 5,769,520 | A | | 6/1998 | Jun et al. | |
| 5,813,741 | A | * | 9/1998 | Fish et al. | 312/408 |
| 5,947,574 | A | * | 9/1999 | Avendano | 312/408 |
| 6,024,333 | A | * | 2/2000 | Raasch et al. | 248/247 |
| 6,199,706 | B1 | * | 3/2001 | Shea | 211/87.01 |
| 6,202,965 | B1 | * | 3/2001 | Chong | 248/220.43 |
| 6,773,651 | B1 | * | 8/2004 | Goyette et al. | 264/237 |
| 7,240,803 | B2 | * | 7/2007 | Stitchick et al. | 211/106 |
| 7,731,316 | B2 | * | 6/2010 | Wing | 312/408 |
| 2005/0217305 | A1 | | 10/2005 | Park et al. | |
| 2005/0280341 | A1 | * | 12/2005 | Vardon | 312/408 |
| 2006/0213849 | A1 | * | 9/2006 | Bienick | 211/90.02 |

* cited by examiner

REFRIGERATION DEVICE COMPRISING SHELVES THAT ARE SUSPENDED ON A RAIL

BACKGROUND OF THE INVENTION

The present invention relates to a refrigeration device with shelves which are suspended on perforated rail which is securely mounted in the body of the refrigeration device. Such a refrigeration device is known from DE 10 2004 021 857 A1.

The suspension of shelves on a rail of this kind has the advantage that the internal container walls of the refrigeration device can be embodied to be largely flat and thus easy to clean. One problem is, however, that after lengthy use shelves suspended on the rails tend no longer to come free from the rails without further action, whether because they jam fast together as a result of manufacturing tolerances, or because they are stuck together by an accumulation of food residues, or are simply frozen in position.

BRIEF SUMMARY OF THE INVENTION

The aim of the present invention is to develop a refrigeration device of the type specified at the outset such that easy release of the shelf support from the rail is guaranteed at all times.

The object is achieved firstly by a refrigeration device with at least one vertical rail, which is securely connected to the body and is provided with through-openings at a distance from each other, and at least one shelf support, which has a rear flank facing a front side of the rail and one upper and one lower hook with downward oriented free hook tips, which in each case protrude over the rear flank and engage in one of the through-openings, characterized in that of the free tips of the two hooks only the tip of the upper hook touches a rear side of rail at least in parts, and that only a section of the rear flank below the lower hook touches the front side of the rail.

This embodiment guarantees that the shelf support cannot be released from the rail solely by means of lifting and subsequent withdrawal from the through-openings, but when in the suspended state a small degree of swiveling freedom exists, by means of which possible encrustations between rail and shelf support can be readily dislodged.

In order to improve the pivoting mobility of the refrigerated goods carrier, the rear flank preferably has an opening between its section touching the rail and the lower hook.

Secondly, as an alternative to or in combination with the abovementioned features, the object is also achieved in that the lower hook rests on the lower edge of a through-opening through which it reaches, while the upper hook runs at a distance from the lower edge of the through-opening through which it reaches. The distance between the lower edge of the through-opening and the upper hook prevents mutual adhesion, which facilitates the release of the shelf supports from the rail both by means of lifting while retaining its orientation and by means of a pivoting movement preparatory to the lifting.

In order to prevent faults when suspending the shelf supports on the rail, the distance between an upper edge of the lower hooks and a lower end of the rear flank is preferably greater than the height of the through-openings.

The shelf support is realizable at reasonable cost, in that a plate encompassing the hook is manufactured from metal and an element surrounding the plate in friction-fitted manner is manufactured from plastic. The plastic element can be molded in one piece with a frame enclosing a plate of the shelf.

In order to afford the plastic element a high degree of stability, this preferably has a base plate touching the metal plate and ribs protruding from the base plate, which surround the edges of the metal plate.

As the plate is arranged on a side of the base plate facing a side wall of the body, it is practically invisible within the refrigeration device, so that only the plastic element determines the appearance of the shelf support, and no exacting requirements need be placed on the surface quality of the metal plate.

BRIEF DESCRIPTION OF THE DRAWINGS

Further features and advantages of the invention are evident from the following description of exemplary embodiments, with reference to the attached Figures, in which.

DETAILED DESCRIPTION OF EXEMPLARY EMBODIMENTS OF THE PRESENT INVENTION

Figure 1:
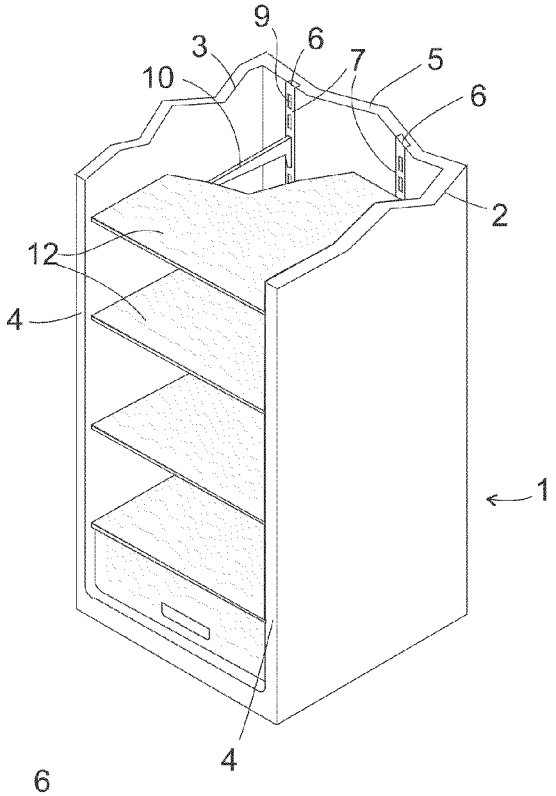
FIG. 1 shows a three-dimensional, scrap view of a first embodiment of an inventive second refrigeration device.

The refrigeration device carcass 1 shown in partially cutaway form in FIG. 1 comprises in an essentially known manner an external skin 2 assembled from rigid elements such as sheet metal sections and an internal container 3, which delimit walls 4, 5 filled with insulating foam material. On the rear wall 5 two vertical grooves 12 are formed in the internal container 3, which extend over the entire height of the interior compartment and into which are inserted hollow carrier rails 6 of rectangular cross-section.

Figure 2:
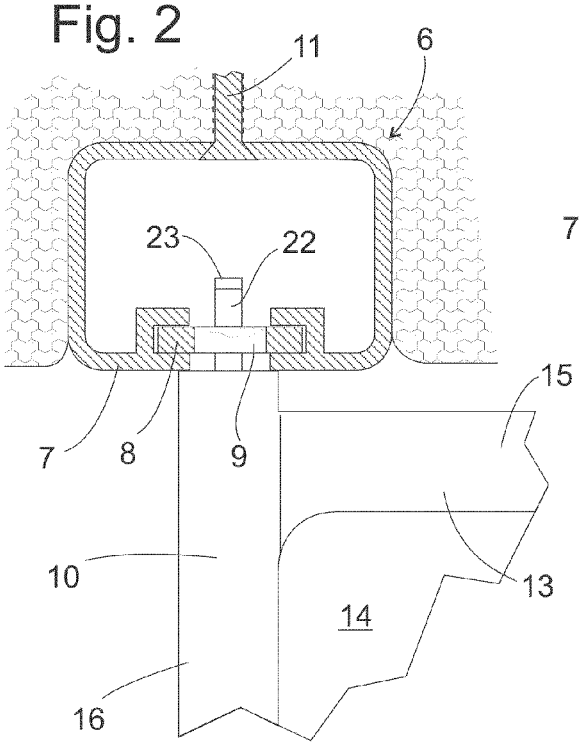
FIG. 2 shows a horizontal section through a vertical rail and its environs.

FIG. 2 shows a horizontal section through a carrier rail 6 along a plane above a carrier arm 10 hung on the carrier rail 6. The carrier rails 6 in each case comprise an external profile 7 of essentially C-shaped cross-section, where the open side of the C-shape faces the interior compartment of the body 1, and a strip 8, which is guided vertically in a slidable manner into two grooves of the arm of the external profile 7 which face each other. The strip 8 is provided with through-openings 9 at regular intervals, of which one is shown in sectional form in FIG. 2. The carrier arm 10 shown in part in an overhead view engages in other, deeper-lying through-openings 9 of the strip 8.

Figure 3:
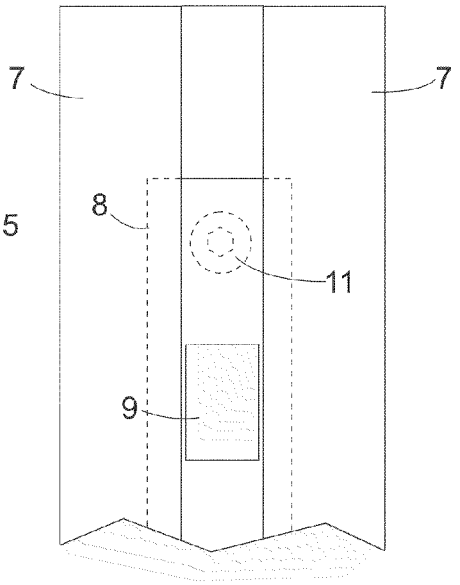
FIG. 3 shows a frontal view of part of the rail.

While the external profile 7 extends over the entire height of the internal container 3, the strip 8 is slightly shorter. As can be seen in the front view of the upper region of the carrier rail 6 in FIG. 3, the strip 8 does not extend as far as the upper end of the external profile 7. Accordingly, the strip 8 can be slid vertically within the external profile 7 and can be raised into a position in which a screw 11 which anchors the external profile 7 to the rear wall 5 of the body 1, shown by means of a dotted line in FIG. 3 because it is concealed by the strip 8, is accessible through one of the through-openings 9. When the refrigeration device is assembled and ready for operation, the screws 11 of both carrier rails 6 are in each case concealed behind the strip 8; they are nevertheless readily accessible by sliding the strips 8, if it should be necessary to remove one of the carrier rails 6.

The carrier arms 10 of a shelf 12 can be embodied as elements capable of being hung on the carrier rails 6 separately from each other, which extend over a majority of the depth of the internal container 3, so that the shelf 12 can be placed loose upon this, as indicated in view in FIG. 1.

Figure 4:
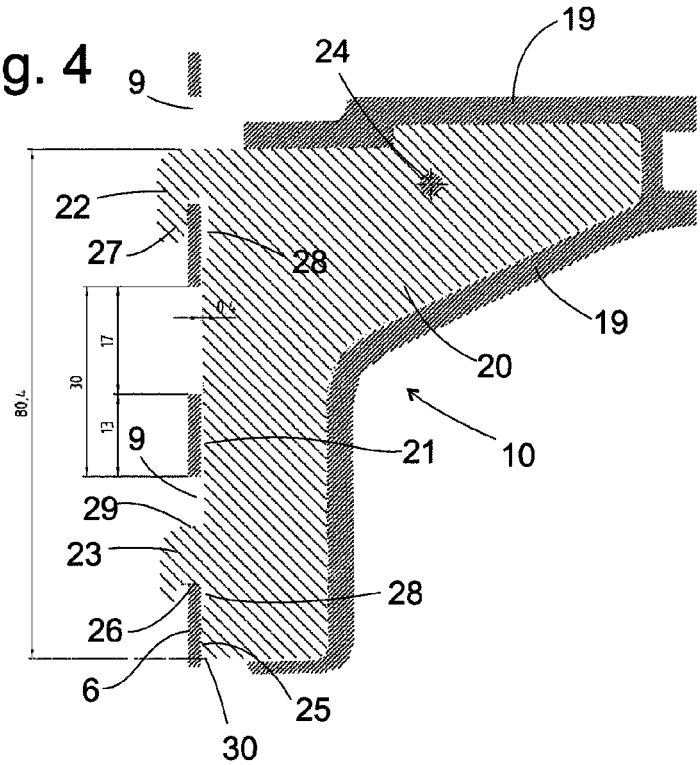
FIG. 4 shows a partial side view of a refrigerated goods carrier suspended on a rail according to a second embodiment.
Figure 5:
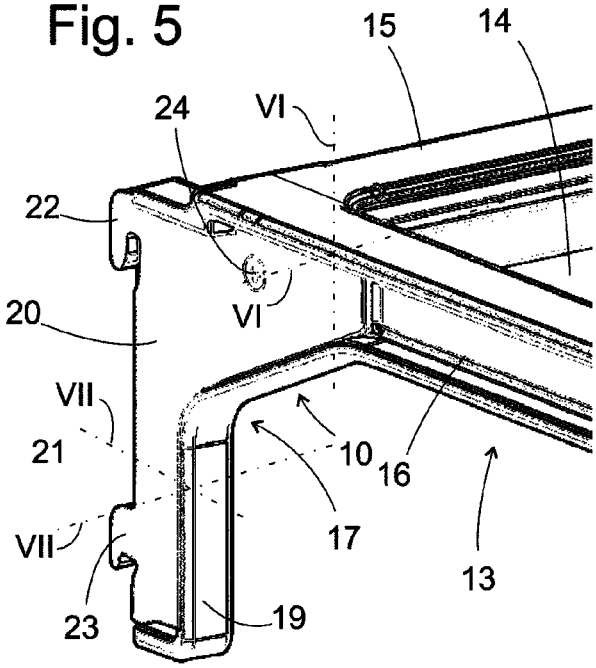
FIG. 5 shows a partial three-dimensional view of the refrigerated goods carrier from FIG. 2.

According to a preferred development, the carrier arms 10 are, as shown in FIGS. 2, 4 and 5, molded together with a frame 13 enclosing a base plate 14 of a shelf 12 to form a functional unit. In this embodiment, the frame 13 comprises four braces formed from injection-molded plastic or cast aluminum, two cross-braces running in the width direction of the body, of which a rear example 15 is partially visible in FIG. 2 and FIG. 5, and two longitudinal braces 16, of which the left-hand example is partially visible in FIG. 2 and FIG. 5. The cross- and longitudinal braces 15, 16 can be formed integrally or in one piece around the base plate 14.

Figure 6:
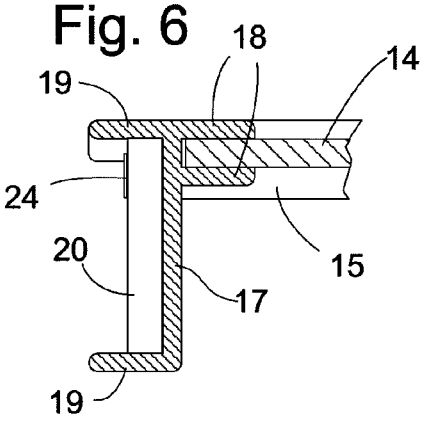
FIG. 6 shows a vertical section along the line designated VI-VI in FIG. 5.
Figure 7:
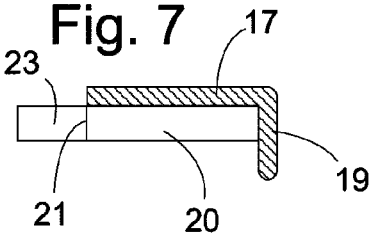
FIG. 7 shows a horizontal section along the line designated VII-VII in FIG. 5.

FIG. 6 and FIG. 7 in each case show a section through the left-hand longitudinal brace 16 along a vertical plane designated VI-VI or, respectively, a horizontal plane designated VII-VII in FIG. 5. In its rear area, the longitudinal brace 16 has a vertically oriented base plate 17 of large area, from which two ribs 18 project on one side, which delimit a groove accommodating the edge of the base plate 14. Two studs 19 projecting on the opposite side of the base plate 17 enclose in a friction-fitted manner a metal plate 20, in the present case embodied in stainless steel, from whose rear flank 21 protrude two downward curved hooks 22, 23.

The steel plate 20 is fixed to the base plate 17 with the aid of a screw 24, which penetrates the steel plate 20 and the base plate 17 and engages in a thread of the rear cross-brace 15. By means of the screw connection on the one hand and the friction-fitted enclosure of the edges of the steel plate 20 by the studs 19 on then other hand, a load-bearing joint is created between the steel plate 20 and the longitudinal brace 16.

The hooks 22, 23 are provided in order to engage in through-openings 9 of the strip 8 of one of the carrier rails 6. As shown in the detailed view in FIG. 4, the hooks 22, 23 are of different shape, and the rear flank 21 does not abut the strip 8 over its entire length. Rather it maintains a distance of at least approx. 0.4 mm from the strip 8 over a section between the hooks 22, 23 and touches these only in an area 25 lying below the lower hooks 23. The lower hook 23 has a horizontal lower edge 26, which rests on the edge of a through-opening 9. A corresponding lower edge 26 of the upper hook 22 is spaced at a distance from the lower edge of the through-opening 9 through which this hook reaches. Only a downward oriented free tip 27 of the upper hook 22 abuts the rear side of the strip 8. These three points of contact between carrier arm and strip 8 are sufficient to bear the weight of the shelf and items placed upon it and a torque created thereby.

The recesses delimited by the hooks 22, 23 and open towards the bottom, in which the strip 8 engages, are significantly wider than the thickness of the material of the strip 8. Openings 28 are in each case embodied on the rear flank 21 of both hooks 22, 23, which permit the carrier arm in each case to be pivoted slightly in the counterclockwise direction, in opposition to the torque of a load placed on the shelf, prior to suspension from the carrier rail 6, thus loosening possible encrustations between carrier arm and carrier rail or releasing jams. The fact that the carrier arm is integrally molded with the shelf to form a rigid unit reduces the risk of jamming.

In order to prevent incorrect suspension of the carrier arms on the strip, the distance between an upper edge 29 of the hook 23 and a lower corner 30 of the section 25 is greater than the height of the through-opening 9. Thus the hook 23 and the lower corner 30 cannot be inserted in a through-opening 9 at the same time.

The invention claimed is:

1. A refrigeration device comprising:

a body; and at least one vertical rail, the vertical rail being secured to the body and having a front side and a rear side, a plurality of through-openings spaced from each other, and at least one shelf support, the at least one shelf support having a rear flank that faces the front side of the vertical rail in an installed position of the at least one shelf support on the vertical rail, an upper hook with a free hook tip oriented downwardly in the installed position of the at least one shelf support on the vertical rail at a spacing from, and partially co-extensive with, the rear flank, and a lower hook with a free hook tip oriented downwardly in the installed position of the at least one shelf support on the vertical rail at a spacing from, and partially co-extensive with, the rear flank and, in the installed position of the at least one shelf support on the vertical rail, the lower hook is in engagement with a respective one of the through-openings of the vertical rail and the upper hook is in engagement with a respective one of the through-openings of the vertical rail with only the free hook tip of the upper hook being in contact with the rear side of the vertical rail and the free hook tip of the lower hook being substantially not in contact with the rear side of the vertical rail, as between the free hook tips of the upper and lower hooks of the at least one shelf support, and only the rear flank of the at least one shelf support below the lower hook being in contact with the front side of the vertical rail, as between the rear flanks of the at least one shelf support below the upper and lower hooks, wherein the lower hook rests on a lower edge of the respective one of the through-openings with which it is engaged, and the upper hook does not rest on a lower edge of the respective one of the through-openings with which it is engaged.

2. The refrigeration device as claimed in claim 1, wherein the rear flank of the at least one shelf support has an opening between the portion thereof in contact with the vertical rail and the lower hook.

3. The refrigeration device as claimed in claim 1, wherein the distance between an upper edge of the lower hook and a lower end of the rear flank is greater than the height of the through-openings.

4. The refrigeration device as claimed in claim 1, wherein the at least one shelf support includes a metal plate encompassing the upper and lower hooks and a shaped element enclosing the metal plate in a friction-fit manner.

5. The refrigeration device as claimed in claim 1, wherein the shaped element includes a base plate touching the metal plate and ribs protruding from the base plate that engage the edges of the metal plate.

6. The refrigeration device as claimed in claim 5, wherein the metal plate is arranged on a side of the base plate facing a side wall of the body.

7. A refrigeration device comprising:

a body;

a vertical rail, the vertical rail being secured to the body and having a front side, a rear side, and a plurality of through-openings spaced from each other; and a shelf support having a rear flank that faces the front side of the vertical rail in an installed position of the shelf support on the vertical rail, an upper hook with a tip oriented downwardly in the installed position of the shelf support on the vertical rail at a spacing from the rear flank, and a lower hook with a tip oriented downwardly in the installed position of the shelf support on the vertical rail at a spacing from the rear flank, wherein, in the installed position of the shelf support on the vertical rail, the lower hook is in engagement with a respective one of the through-openings, the upper hook is in engagement with a respective one of the through-openings with only the tip of the upper hook being in contact with the rear side of the vertical rail, the tip of the lower hook is substantially not in contact with the rear side of the vertical rail, the only portion of the rear flank in contact with the front side of the vertical rail is below the lower hook, the lower hook rests on a lower edge of the respective one of the through-openings with which it is engaged, and the upper hook does not rest on a lower edge of the respective one of the through-openings with which it is engaged.

8. The refrigeration device as claimed in claim 7, wherein the rear flank has an opening between the portion thereof in contact with the vertical rail and the lower hook.

9. The refrigeration device as claimed in claim 7, wherein a distance between an upper edge of the lower hook and a lower end of the rear flank is greater than the height of the through-openings.

10. The refrigeration device as claimed in claim 7, wherein the shelf support includes a metal plate encompassing the upper and lower hooks and a shaped element enclosing the metal plate in a friction-fit manner.

11. The refrigeration device as claimed in claim 10, wherein the shaped element includes a base plate touching the metal plate and ribs protruding from the base plate that engage the edges of the metal plate.

12. The refrigeration device as claimed in claim 11, wherein the metal plate is arranged on a side of the base plate facing a side wall of the body.

13. A refrigeration device comprising:

a body;

a vertical rail, the vertical rail being secured to the body and having a front side, a rear side, and a plurality of through-openings spaced from each other, each of the through-openings having a lower edge; and a shelf support having a rear flank that faces the front side of the vertical rail in an installed position of the shelf support on the vertical rail, an upper hook having a tip oriented downwardly in the installed position of the shelf support on the vertical rail at a spacing from the rear flank, and a penetration section, the penetration section being that portion of the upper hook that is located in one of the through-openings in the installed position, the penetration section having a lower surface, and a lower hook having a tip oriented downwardly in the installed position of the shelf support on the vertical rail at a spacing from the rear flank, and a penetration section, the penetration section being that portion of the lower hook that is located in one of the through-openings in the installed position, the penetration section having a lower surface, wherein in the installed position, the upper hook is in engagement with a first one of the through-openings with only the tip of the upper hook being in contact with the rear side of the vertical rail, in the installed position, the lower hook is in engagement with a second one of the through-openings with the tip of the lower hook substantially not in contact with the rear side of the vertical rail, the only portion of the rear flank in contact with the front side of the vertical rail is below the lower hook, and a vertical distance between the lower edge of the first through-opening and the lower edge of the second through-opening is less than a vertical distance between the lower surface of the penetration section of the upper hook and the lower surface of the penetration section of the lower hook.

14. The refrigeration device as claimed in claim 13, wherein the rear flank has an opening between the portion thereof in contact with the vertical rail and the lower hook.

15. The refrigeration device as claimed in claim 13, wherein a distance between an upper edge of the lower hook and a lower end of the rear flank is greater than the height of the through-openings.

16. The refrigeration device as claimed in claim 13, wherein the shelf support includes a metal plate encompassing the upper and lower hooks and a shaped element enclosing the metal plate in a friction-fit manner.

17. The refrigeration device as claimed in claim 16, wherein the shaped element includes a base plate touching the metal plate and ribs protruding from the base plate that engage the edges of the metal plate.

18. The refrigeration device as claimed in claim 17, wherein the metal plate is arranged on a side of the base plate facing a side wall of the body.

* * * * *